US006814351B2

(12) United States Patent
Koelle

(10) Patent No.: US 6,814,351 B2
(45) Date of Patent: Nov. 9, 2004

(54) METHOD AND DEVICE FOR ARRANGING AT LEAST TWO SHEETS IN A SHINGLED MODE OF ARRANGEMENT

(75) Inventor: Helmut Koelle, Augsburg (DE)

(73) Assignee: Boewe Systems AG, Augsburg (DE)

( * ) Notice: Subject to any disclaimer, the term of this patent is extended or adjusted under 35 U.S.C. 154(b) by 0 days.

(21) Appl. No.: 10/054,265

(22) Filed: Jan. 22, 2002

(65) Prior Publication Data

US 2002/0105131 A1 Aug. 8, 2002

Related U.S. Application Data

(63) Continuation of application No. PCT/EP00/06024, filed on Jun. 28, 2000.

(30) Foreign Application Priority Data

Jul. 27, 1999 (DE) ..... 199 35 186

(51) Int. Cl.[7] ..... B65H 5/02

(52) U.S. Cl. ..... 271/9.13; 271/9.12; 271/202; 271/225

(58) Field of Search ..... 271/275, 198, 271/202, 203, 216, 151, 270, 256, 9.13, 225, 197, 9.11, 9.12

(56) References Cited

U.S. PATENT DOCUMENTS

| | | | | | |
|---|---|---|---|---|---|
| 1,931,454 | A | * | 10/1933 | Anderson | 198/448 |
| 3,108,796 | A | * | 10/1963 | Dietrick | 270/58.3 |
| 3,178,170 | A | | 4/1965 | Watch et al. | 270/58 |
| 3,271,023 | A | | 9/1966 | Disbrow et al. | 270/58 |
| 3,693,486 | A | * | 9/1972 | Maniaci et al. | 83/88 |
| 4,541,824 | A | | 9/1985 | Muller | 493/29 |
| 4,572,497 | A | | 2/1986 | Dreschel et al. | 270/58 |
| 4,674,375 | A | | 6/1987 | Golicz | 83/91 |
| 4,770,407 | A | * | 9/1988 | Nail | 271/275 |
| 5,112,041 | A | | 5/1992 | Honegger | 271/286 |
| 5,445,368 | A | | 8/1995 | Lester et al. | 270/59 |
| 5,704,604 | A | | 1/1998 | Koelle et al. | 270/52.09 |
| 5,711,521 | A | | 1/1998 | Reist | 271/225 |
| 5,790,168 | A | * | 8/1998 | Sano et al. | 347/262 |
| 6,062,556 | A | * | 5/2000 | McCay | 271/9.13 |
| 6,155,562 | A | | 12/2000 | Pollock et al. | 271/279 |
| 6,158,735 | A | | 12/2000 | Cote et al. | 271/302 |
| 6,341,773 | B1 | * | 1/2002 | Aprato et al. | 271/9.13 |
| 6,378,861 | B1 | * | 4/2002 | Middelberg et al. | 271/225 |
| 6,460,842 | B1 | * | 10/2002 | Koelle | 270/58.01 |
| 6,460,844 | B1 | * | 10/2002 | Clifford et al. | 271/9.13 |

FOREIGN PATENT DOCUMENTS

| | | | | |
|---|---|---|---|---|
| DE | 198 36 231 A1 | | 3/1999 | B65G/47/68 |
| DE | 198 11 635 A1 | | 9/1999 | |
| DE | 198 19 736 C1 | | 9/1999 | B56H/39/02 |
| DE | 19935186 C1 | * | 11/2000 | |
| EP | 0 155 633 B1 | | 6/1988 | |
| EP | 0 214 458 B1 | | 10/1988 | |
| GB | 2 083 448 A | | 3/1983 | B56H/35/00 |
| WO | WO 99/61175 | | 12/1999 | B07C/1/02 |

OTHER PUBLICATIONS

PCT International Search Report for Application No. PCT/EP00/06024, filed Jun. 28, 2000.

* cited by examiner

*Primary Examiner*—Patrick Mackey
(74) *Attorney, Agent, or Firm*—Gardner Groff, P.C.

(57) ABSTRACT

The present invention relates to a method and a device for arranging at least two sheets in a shingled mode of arrangement, wherein a first sheet is moved in a paper travelling direction, and a second sheet is simultaneously moved in a direction at an angle relative to the paper travelling direction in such a way that the at least two sheets are slid one on top of the other. Alternatively, the first and the second sheet are moved in a first and in a second direction at respective different angles relative to a paper travelling direction. Another alternative is to move the two sheets in a first and in a second direction at different speeds but at identical angles relative to the paper travelling direction.

17 Claims, 11 Drawing Sheets

METHOD AND DEVICE FOR ARRANGING AT LEAST TWO SHEETS IN A SHINGLED MODE OF ARRANGEMENT

CROSS-REFERENCE TO RELATED APPLICATIONS

This application is a continuation of PCT application number PCT/EP00/06024 filed Jun. 28, 2000 under 35 U.S.C. §120.

BACKGROUND OF THE INVENTION

1. Field of the Invention

The present invention relates to a method and a device for a arranging at least two sheets in a shingled mode of arrangement.

2. Description of Related Art

In the prior art methods and devices are already known, which are used for superimposing sheets discharged by a cutter in a 2-up mode of operation.

DE 34 33 497 A1 describes a device in which juxtaposed paper sheets are conducted into a merger having provided therein a conveying belt which extends transversely to a longitudinal axis of the device and by means of which one paper sheet is transported transversely to the longitudinal plane of the device and is thus slid on top of the other paper sheet.

DE 198 19 736 C1 discloses a device for superimposing paper sheets in which the paper sheets, which are initially arranged side by side, are slid one on top of the other via two planes by means of vacuum-type conveying belts, this being achieved in that the vacuum-type conveying belts are arranged at an oblique angle relative to the paper travelling direction.

U.S. Pat. No. 3,178,170 discloses a device for collecting individual sheets in which the sheets, which are provided in the device in juxtaposed relationship, are slid on top of one another by means of obliquely arranged transport rolls, the transport rolls being driven in common.

GB 2 083 448 A discloses a cutter and merger device by means of which a stack of superimposed sheets is produced from a plurality of single sheets.

GB 2 083 448 A discloses a cutter and merger device by means of which a stack of superimposed sheets is produced from a plurality of single sheets.

U.S. Pat. No. 4,674,375 relates to a merger in which three individual sheets, which were cut in a preceding section and which are present in parallel on the inlet of the machine, are merged into a stack in such a way that the individual sheets are arranged one on top of the other. The sheets are slid on top of one another and a stacking assembly by means of which the individual sheets are merged into a respective stack is provided only at the outlet of the device. The individual sheets are moved by transport rolls, which are driven in common.

One feature that is common to all the above-described systems, which are already known from the prior art, is that they only provide the possibility of superimposing at least two sheets which are supplied to such a device, the orientation of the superimposed sheets being in this connection always such that they form a stack in which the individual sheets are superimposed with all the edges flush.

In cases of use where e.g. the individual sheets were produced by respective cutting operations of cutters which are known per se, and are then merged into stacks by the above-described devices, and where further processing of these elements is then necessary, e.g. a grouping of individual documents, enveloping or the like, it will be necessary, not least in order to save space, to arrange the sheets in a shingled mode of arrangement, i.e. such that the sheets advanced are arranged one on top of the other with a small amount of longitudinal displacement, when the transport of the individual stacks is being continued. Related to predetermined dimensions, this will permit an increase in the transport capacity in comparison with the transport capacity in cases in which only individual sheets would be transported.

The above-described course of action, viz. sliding the individual sheets first on top of one another and depositing them in a stacked mode of arrangement and arranging them subsequently in a shingled mode of arrangement, necessitates, however, additional processing steps, since the individual sheets, which are discharged from the merger, are first collected in the form of a stack, whereupon each individual sheet must be drawn off from the stack formed, so as to accomplish the shingled mode of arrangement of these sheets; this necessitates additional operating steps and leads to a reduction of the operating speed, since e.g. during a clock cycle which is, for example, 200 ms long, only a single sheet can be drawn off, so that as much as 400 ms, i.e. two clock cycles of the operating cycle, are necessary for arranging two sheets in a shingled mode of arrangement.

DE 198 36 231 A1 refers to a device for transporting documents from at least two separate inlets to a common outlet; by means of this device a shingled mode of arrangement of the documents coming from the two separate inlets can be achieved at the common outlet. In particular, a first straight transport path is provided, which leads from one inlet to the common outlet, whereas a further transport path, which leads from the other inlet to the common outlet, extends at an oblique angle relative to the first transport path. In addition, the transport paths extend on different levels so that the lengths of the transport paths are different due to the fact that a transport path extends at an oblique angle and due to the different levels of the two transport paths. The speeds of the transport means along the transport paths can be adjusted independently of one another so that a shingled mode of arrangement, among other modes of arrangement, can be achieved at the common outlet.

SUMMARY OF THE INVENTION

It is the object of the present invention to provide a method and a device for arranging at least two sheets in a shingled mode of arrangement, which permit fast processing of sheets in a paper handling system and which reduce the number of clock cycles required.

The present invention is a method for arranging at least two sheets in a shingled mode of arrangement, the method comprising the steps of moving a first sheet of the at least two sheets in a paper travelling direction, and simultaneously moving a second sheet of the at least two sheets in a direction at an angle relative to the paper travelling direction in such a way that the at least two sheets are slid one on top of the other.

The present invention is a method for arranging at least two sheets in a shingled mode of arrangement, the method comprising the steps of moving a first sheet of the at least two sheets in a first direction at a first angle relative to a paper travelling direction, and a second sheet of the at least two sheets in a second direction at a second angle relative to a paper travelling direction in such a way that the at least two sheets are slid one on top of the other, the first and second angles being different.

The present invention is a method for arranging at least two sheets in a shingled mode of arrangement, the method comprising the steps of moving a first sheet of the at least two sheets in a first direction at a first angle relative to the paper travelling direction at a first speed, and a second sheet of the at least two sheets in a second direction at a second angle relative to the paper travelling direction at a second speed in such a way that the at least two sheets are slid one on top of the other, the first and second angles being identical, and the first and second speeds being different.

The present invention is a device for arranging at least two sheets in a shingled mode of arrangement, the device comprising a first transport means moving a first sheet of at least two sheets in a paper travelling direction, and a second transport means moving a second sheet of the at least two sheets in a direction at an angle relative to the paper travelling direction in such a way that the at least two sheets are slid one on top of the other.

The present invention is a device for arranging at least two sheets in a shingled mode of arrangement, the device comprising a first transport means moving a first sheet of the at least two sheets in a first direction at a first angle relative to a paper travelling direction, and a second transport means moving a second sheet of the at least two sheets in a second direction at a second angle relative to a paper travelling direction in such a way that the at least two sheets are slid one on top of the other, the first and second angles being different.

The present invention is a device for arranging at least two sheets in a shingled mode of arrangement, the device comprising a first transport means moving a first sheet of the at least two sheets in a first direction at a first angle relative to a paper travelling direction at a first speed, a second transport means moving a second sheet of the at least two sheets in a second direction at a second angle relative to a paper travelling direction at a second speed in such a way that the at least two sheets are slid one on top of the other, the first and second angles being identical, and the first and second speeds being different.

Due to the different movements of the individual sheets (different travelling distances and/or different speeds), the present invention succeeds in making a first sheet faster than a second one so that, when the sheets are being slid on top of one another, a displacement in the paper travelling direction is obtained, i.e. the individual sheets are arranged in a shingled mode of arrangement.

According to one embodiment of the present invention, the different speeds of the transport means accomplish a movement of the individual sheets in such a way that a first sheet is faster than a second sheet so that, when the sheets are being slid on top of one another, a displacement in the paper travelling direction is obtained, i.e. the individual sheets are arranged in a shingled mode of arrangement. The first speed $v_1$ of the first sheet is preferably in the range of from 2 m/s to 5 m/s, and the second speed $v_2$ of the second sheet is preferably in the range of from $1.05 \times v_1$ to $1.2 \times v_1$, i.e. it is 5% to 20% higher than $v_1$. The displacement of the edges representing the leading edges in the paper travelling direction is preferably in the range of from 10 mm to 50 mm.

According to a further preferred embodiment, the method according to the present invention and the device according to the present invention are implemented such that the sheets are displaced by half their format width in a direction perpendicular to the paper travelling direction.

According to a further preferred embodiment of the device according to the present invention, the transport means in a transfer station are implemented as oblique transport means whose transport directions each extend at an acute angle towards a longitudinal centre plane.

According to a further preferred embodiment of the present invention, the transport means are defined by vacuum transport units which are arranged at an oblique angle relative to a paper travelling direction and between which a separating plate is arranged so that the conveying belts of the vacuum transport units cross.

BRIEF DESCRIPTION OF THE DRAWINGS

In the following, preferred embodiments of the present invention will be described in detail making reference to the drawings enclosed, in which.

DESCRIPTION OF THE PREFERRED EMBODIMENTS

The present invention is based on the finding that a shingled mode of arrangement of at least two sheets can be achieved in a merger in a simple manner, as will be described in detail hereinbelow making reference to the three embodiments of the method according to the present invention which are shown in FIG. 1, the devices according to the present invention, which will be described later on, operating according to these methods.

Figure 1A:
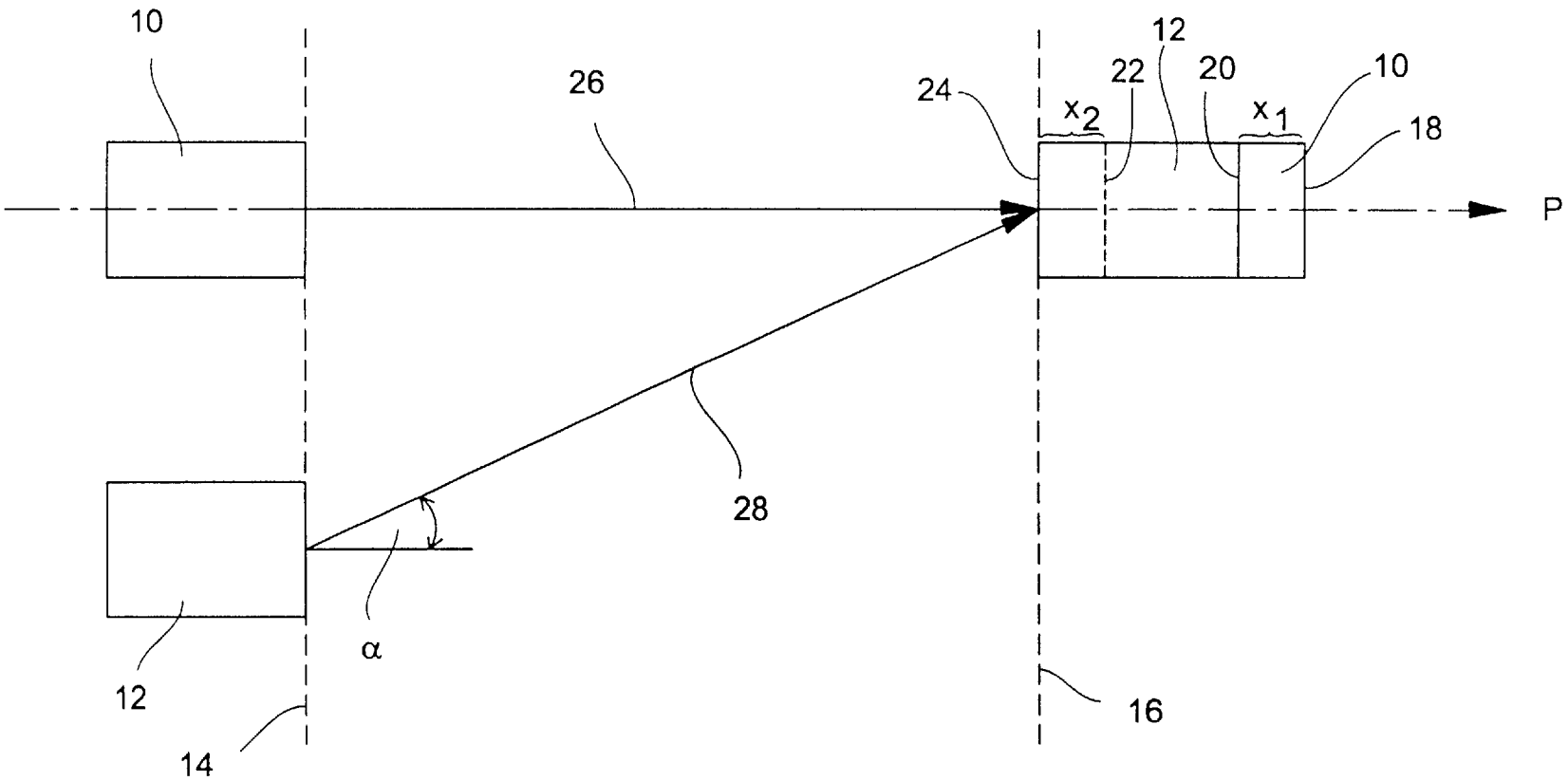
FIGS. 1*a*–1*c* show schematic representations of the method according to the present invention.

FIG. 1*a* shows a first embodiment of the method according to the present invention in the case of which a first sheet 10 and a second sheet 12 are to be arranged in a shingled mode of arrangement. The two sheets 10 and 12 are initially positioned at a starting position 14; from this starting position 14 they are moved in a paper travelling direction P and, at a final position 16, they are arranged in a shingled mode of arrangement, as shown in the right section of FIG. 1*a*. As can be seen, the two sheets 10 and 12 are superimposed; an edge 18 of the first sheet 10 extending in the paper travelling direction P is displaced from an edge 20 of the second sheet 12 extending in the paper travelling direction P by the distance $x_1$. The same applies to the edges of the two sheets 10 and 12 constituting the trailing edges in the paper travelling direction P. The trailing edge 22 of sheet 10 is displaced from the trailing edge 24 of sheet 12 by the distance $X_2$.

In the area between the first position 14 and the second position 16, the first sheet 10 is moved in a direction 26 corresponding to the paper travelling direction P. The second sheet 12 is moved in a second direction 28 which is inclined at an angle α relative to the paper travelling direction P. In accordance with a preferred embodiment of this method, the first sheet 10 and the second sheet 12 are moved at the same speed v, preferably in the range of from 2 m/s to 5 m/s. The displacement of the leading edges occurring in the paper travelling direction is preferably in the range of from 10 mm to 50 mm. According to the present invention, this displacement is achieved in that, due to the longer distance that has to be covered by sheet 12, sheet 10 is faster than sheet 12.

Making reference to FIG. 1*b*, the next embodiment of the method according to the present invention will be described, the arrangement of sheets before section 14 and after section 16 corresponding to the arrangement according to FIG. 1*a* so that a renewed description of this situation is dispensed with.

Figure 1B:
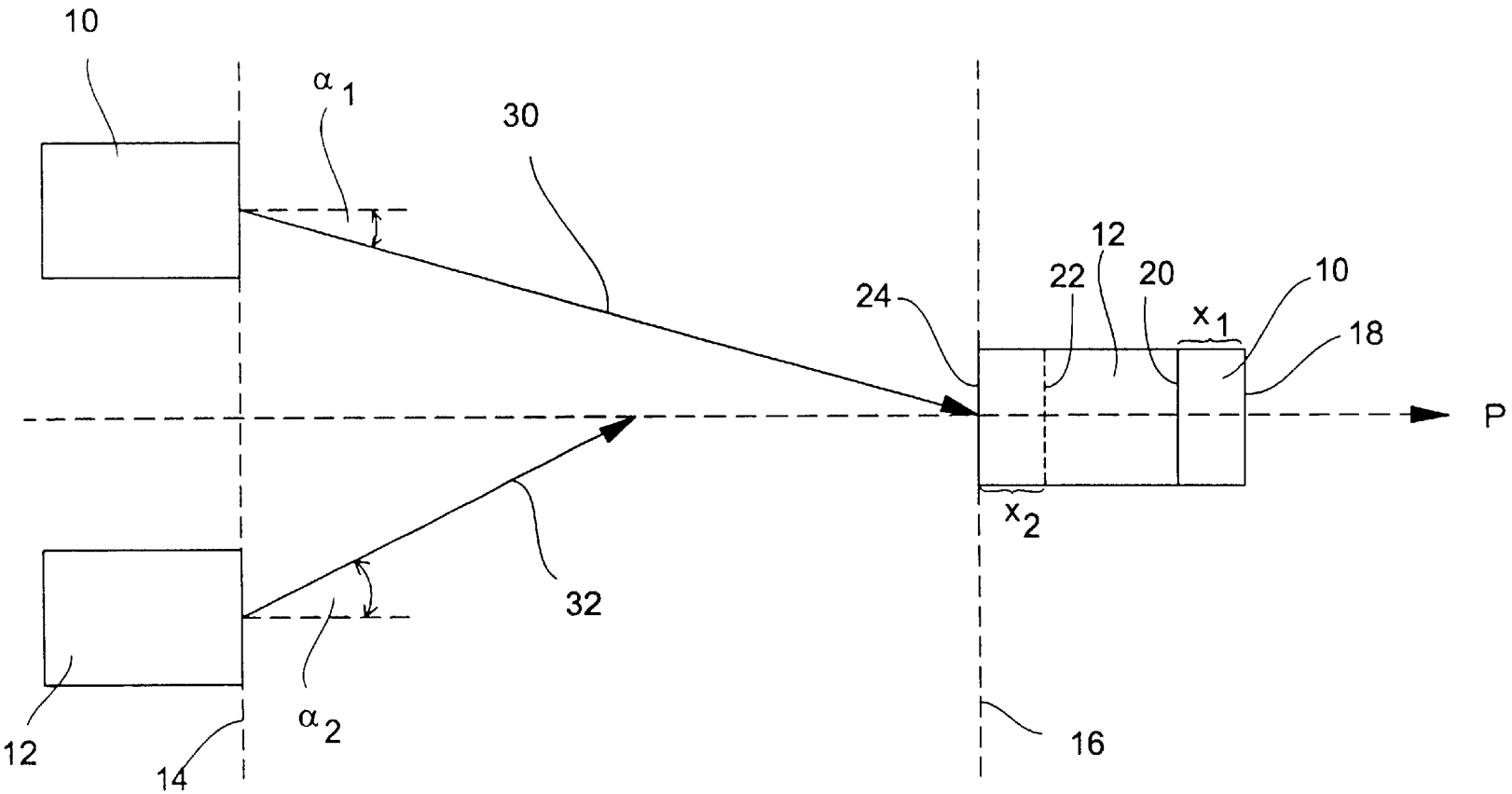

In the embodiment described in FIG. 1*b*, the first sheet 10 moves in a direction 30 in the area between section 14 and section 16, the direction 30 being inclined at the angle α1 relative to the paper travelling direction P. Sheet 12 is moved in a second direction 32, which is inclined by a second angle α2 relative to the paper travelling direction P. As can be seen, the angles α1 and α2 are different so that, when sheets 10 and 12 move at the same speed, the shingled mode of arrangement of the first and second sheets according to the present invention is achieved.

Making reference to FIG. 1*c*, a third preferred embodiment of the method according to the present invention will be described in detail; in so doing, only the movement of the individual sheets 10 and 12 between sections 14 and 16 will be dealt with in detail. As can be seen, the first sheet 10 is moved in a first direction 34, which is inclined at an angle α1 relative to the paper travelling direction P. Likewise, the second sheet 12 is moved in a direction 36, which is inclined at an angle α2 relative to the paper travelling direction. In the embodiment shown in FIG. 1*c*, the angles α1 and α2 are identical and the individual sheets 10 and 12 are moved along directions 34 and 36 at different speeds $v_1$ and $v_2$ so that the shingled mode of arrangement of the two sheets is obtained, as shown in FIG. 1*c*.

Figure 1C:
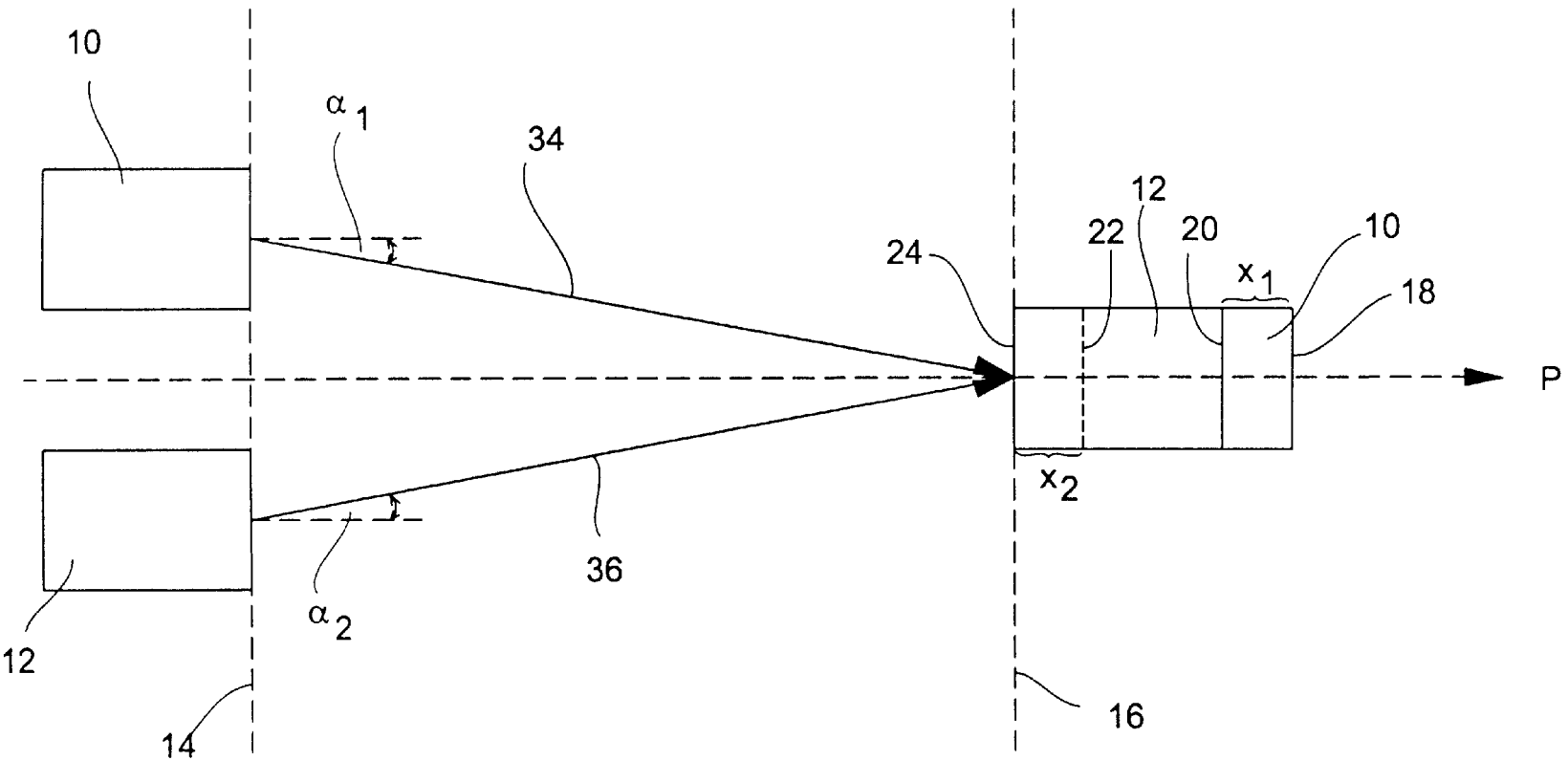

In the embodiment shown in FIG. 1*c*, the arrangement is preferably chosen such that each of the sheets is displaced by half its format width in a direction at right angles to the paper travelling direction P.

Preferably, the first speed $v_1$, at which the first sheet 10 is moved, lies in the range of from 2 m/s to 5 m/s. The second speed $v_2$, at which the second sheet is moved, lies in the range of from $1.05 \times v_1$ to $1.2 \times v_1$, i.e. the second speed $V_2$ is 5% to 20% higher than $v_1$.

The displacement of the leading edges occurring in the paper travelling direction is preferably in the range of from 10 mm to 50 mm.

According to a further embodiment of the present invention, the sheets 10 and 12 to be shingled are arranged side by side in the paper travelling direction P, as can also be seen from FIG. 1, and the shingled sheets are transported away from position 16.

In the following, preferred embodiments of the device according to the present invention will be described making reference to FIGS. 2 to 11, identical or similar elements being provided with identical reference numerals in the individual figures.

Figure 2:
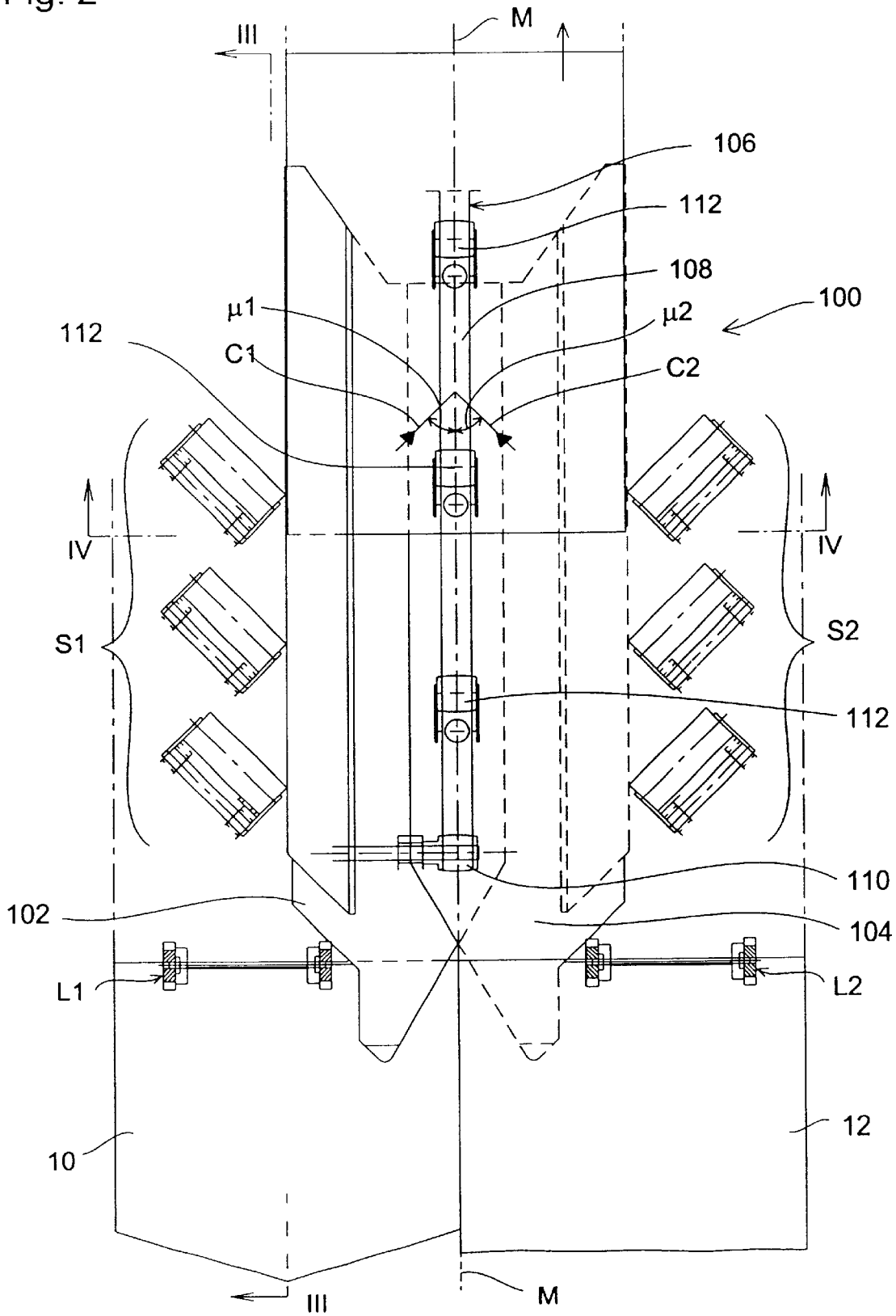
FIG. 2 shows a first embodiment of the device according to the present invention.

In FIG. 2 a first embodiment of the device according to the present invention is shown. A paper web, which is not shown, has printed thereon form texts or the like, whereupon, in a cutter which is not shown either, it is subdivided first in the longitudinal direction and then transversely to this direction into individual printed forms and paper sheets, respectively. In FIG. 2, the paper sheets 10 and 12 are shown, which are arranged side by side in a horizontal paper travelling plane on both sides of a longitudinal centre plane M—M extending at right angles to this paper travelling plane. The paper sheets 10, 12 are moved side by side in the paper travelling direction P into a merger 100 in which the paper sheets 10, 12 first occupy the fully extended position. From this position each of the two paper sheets 10, 12 is moved simultaneously with the other paper sheet at an oblique angle to the longitudinal centre plane M—M in directions C1, C2. During this oblique movement in directions C1 and C2, the paper sheets 10, 12 are slid one on top of the other. In so doing, each of the two paper sheets 10, 12 is displaced by half its format width B beyond the longitudinal centre plane M—M towards the other side of this plane. The oblique movement of the paper sheets 10, 12 preferably takes place at opposed acute angles μ1 and μ2 of approx. 45° obliquely towards the longitudinal centre plane M—M. The mode of operation of the embodiment shown is the mode that has been described making reference to FIG. 1*c*. The first paper sheet 10 and the second paper sheet 12 are moved at different speeds so that the two paper sheets are arranged in a shingled mode of arrangement. Subsequently, the paper sheets 10, 12 are advanced in (shingled) pairs in the direction of the longitudinal centre plane M—M in the direction of arrow P.

The device according to the first embodiment comprises a left and a right unit, which are arranged symmetrically with respect to the longitudinal centre plane M—M and which are adjustable transversely to this longitudinal centre plane M—M depending on the format that has to be dealt with. Each of these units comprises a longitudinal transport means L1, L2 (FIG. 2) with the aid of which the juxtaposed paper sheets 10, 12 can be moved in the direction of the longitudinal centre plane M—M into the merger 100. In the merger 100 a separate oblique transport means S1 and S2, respectively, is provided for each of the two paper sheets 10, 12. The transport directions C1, C2 of these oblique transport means S1, S2 extend in opposite acute angles μ1, μ2 obliquely towards the longitudinal centre plane M—M. The oblique angles μ1 and μ2 are preferably 45°.

In the transfer station, a respective guide plate 102, 104 for each paper sheet 10, 12 is provided in the area of the oblique transport means S1 and S2. Each of the two guide plates 102, 104 extends from one side of the longitudinal centre plane M—M to the other side thereof. The two guide plates 102, 104 are displaceable transversely to the longitudinal centre plane M—M and can therefore be adjusted to the respective format width. In the area of the longitudinal centre plane a discharge transport means 106 is additionally provided for each paper sheet, only the lower discharge transport means being shown in FIG. 2. Each of these discharge transport means 106 comprises an endless conveying belt 108 running over a drive shaft 110 and a tension pulley, not shown. Furthermore, the conveying belt 108 has associated therewith three contact pressure rolls 112.

Figure 3:
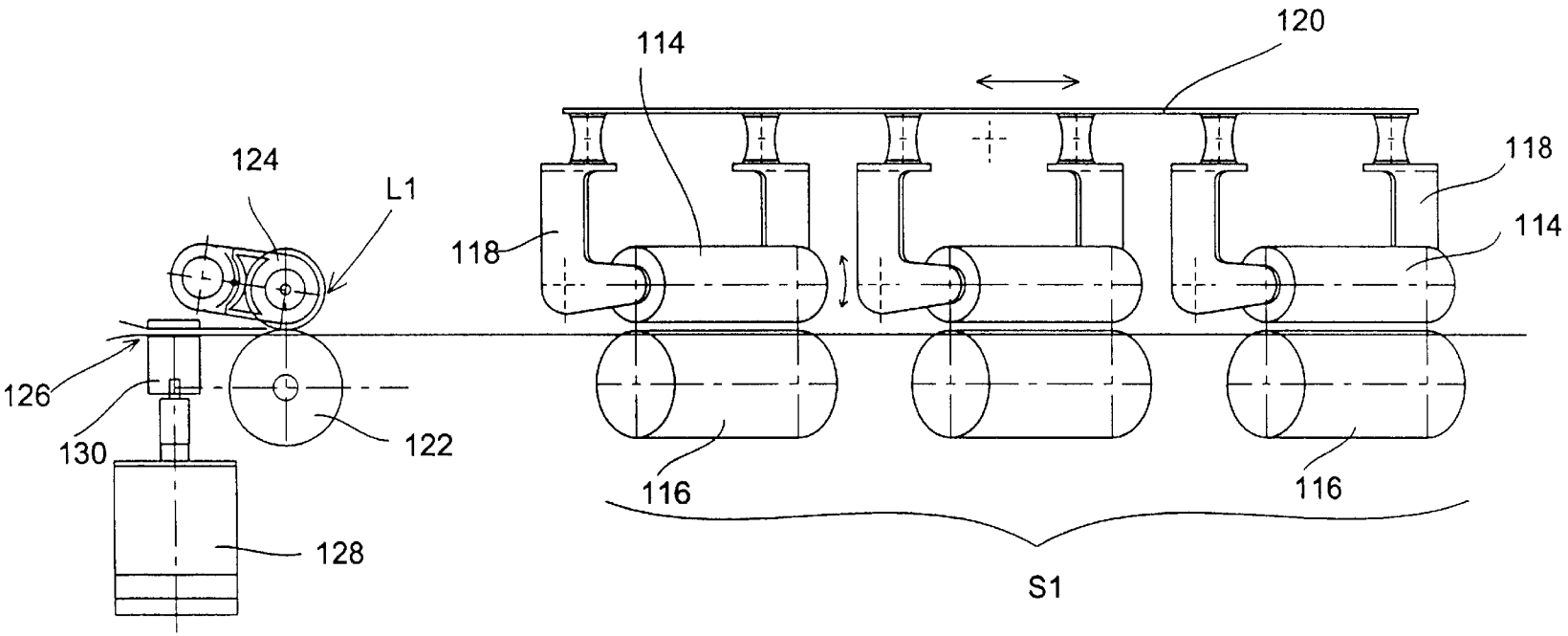
FIG. 3 shows a longitudinal section according to line III—III of FIG. 2.

In FIG. 3 the oblique transport means S1 and the longitudinal transport means L1 are shown in more detail. The oblique transport means S1 comprises a plurality of pairs of rolls 114, 116; the upper roll 114 may consist of rubber and the lower roll 116 of steel. The axes of rotation of these rolls 114, 116 are arranged such that they are inclined at an acute angle of 45° relative to the longitudinal centre plane M—M. The respective upper rolls 114 are supported in bent levers 118 which are, in turn, connected to an operating rod 120. By moving the operating rod 120 to and fro the upper roll 114 can be pressed against the lower roll 116 and raised from this lower roll 116, whereby the oblique transport means S1 can be engaged and disengaged.

The longitudinal transport means L1 comprises a first roll 122, which is adapted to be driven by a motor, not shown, and a second roll 124 which is pretensioned in the direction of the first roll 122. The longitudinal transport means L1 is preceded by a stopper unit 126 comprising a rubber buffer 130 which is adapted to be moved upwards by means of an electro-magnet 128. When, during a group exchange, a paper sheet must be stopped until the juxtaposed paper sheet, which belongs to the preceding group, has been discharged, the associated rubber buffers 130 are forced upwards by switching on the respective electromagnet 128 and the paper sheet above the rubber buffer 130 is fixed in position. The oblique transport means S2 and the longitudinal transport means L2 have the same structural design as the above-described oblique transport means S1 and the longitudinal transport means L2.

Figure 4:
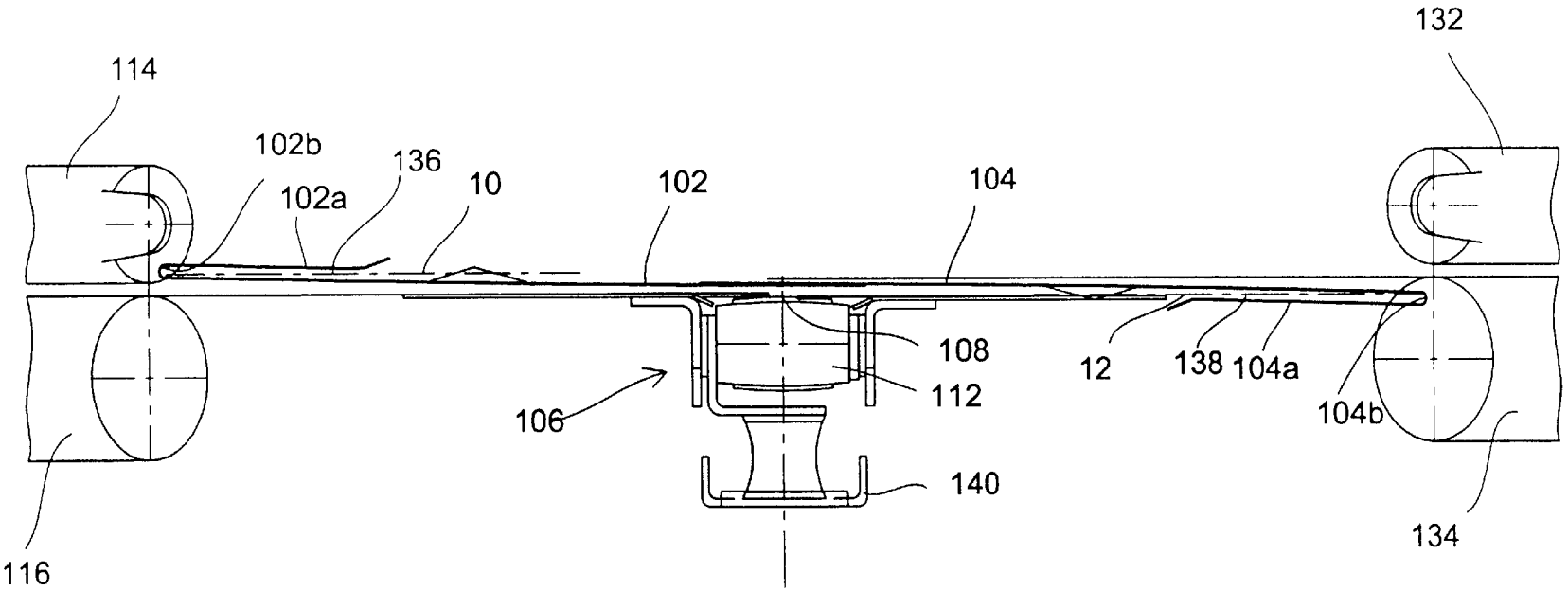
FIG. 4 shows a cross-section according to line IV—IV of FIG. 2.

In FIG. 4, the two oblique transport means S1 and S2 are shown, the oblique transport means S2 comprising a plurality of pairs of rolls 132, 134. In addition, the guide plates 102, 104 are shown, which each have an 180° bent portion 102*a* and 104*a*, respectively, on a longitudinal side thereof so that guide ducts 136, 138 are formed between the respective guide plate 102 and the bent portion 102*a* as well as between the guide plate 104 and its bent portion 104*a*. The inner side 102*b* or 104*b* of the bent area defines a stop means extending parallel to the longitudinal centre plane M—M. The three contact pressure rolls 112 of the conveying belt 108 of the discharge transport means 106 are movable in the direction of the associated guide plate 102, 104 by means of a common push rod 140 so that the respective conveying belt 108 is pressed against the associated guide plate. An paper sheet located therebetween will then be advanced.

In the following, the mode of operation of the device will be explained in more detail making reference to FIGS. 2 to 4.

The longitudinal transport means L1, L2 are driven at a conveying speed which is slightly higher than the maximum discharge speed of the cutter. The longitudinal transport means L1, L2 draw the two paper sheets 10, 12 into the merger 100, the upper rolls 114, 132 of the oblique transport means S1, S2 being first raised from the lower rolls 116, 134. As soon as each paper sheet 10, 12 has been drawn into the merger 100 almost completely, the upper rolls 114, 132 are pressed onto the lower rolls 116, 134 of the oblique transport means S1, S2, whereby paper sheet 10 will be moved in direction C1 at an oblique angle towards the longitudinal centre plane M—M, whereas paper sheet 12 will be displaced in direction C2 at an oblique angle towards the longitudinal centre plane M—M. In the course of this operation, the conveying belts 108 of the discharge means 106 are raised from the associated guide plates 102, 104. Paper sheet 10 is displaced at an oblique angle to the right according to FIGS. 2 to 4 and, during this displacement, it moves into the guide duct 138 until it comes into contact with the stop means 104*b*. Paper sheet 12 is moved at an oblique angle to the left into the duct 136 where it comes finally into contact with the stop means 102*b*. The oblique transport means S1, S2 are adjusted to the respective format width in such a way that the rolls 114, 116 and 132, 134, respectively, will be disengaged from the respective paper sheet 10, 12 when the longitudinal edges of the paper sheets 10, 12 reach the stop means 102*b* and 104*b*. When this is the case, the conveying belts 108 are pressed against the respective paper sheets and the associated guide plates 102, 104 by means of the contact pressure rolls 112; this has the effect that the two superimposed paper sheets 10, 12 are advanced in direction F and discharged. In the course of this process, the oblique transport means S1 and S2 cause the sheets 10 and 12 to move at a first speed and at a second speed which is different from said first speed, as has been described hereinbefore.

Transport of the paper sheets 10, 12 is supervised by light barriers, which are not shown; these light barriers control electromagnets, which are not shown and which act on the operating rod 120 of the oblique transport means S1, S2 and on the contact pressure rolls 112 of the discharge transport means 106.

In FIGS. 5 to 11, a second embodiment of the device according to the present invention is shown. A printed paper web, not shown, is subdivided first in the longitudinal direction and then also transversely to this direction into individual paper sheets 10, 12, in a cutter, which is not shown. The paper sheets 10, 12 are arranged side by side in a horizontal paper travelling plane E—E in two parallel rows R1 and R2 and are advanced with the aid of a transport means, not shown, in the paper travelling direction to the merger 200 shown in FIGS. 5 and 6. The paper travelling direction P extends in the direction of these rows R1 and R2.

Figure 6:
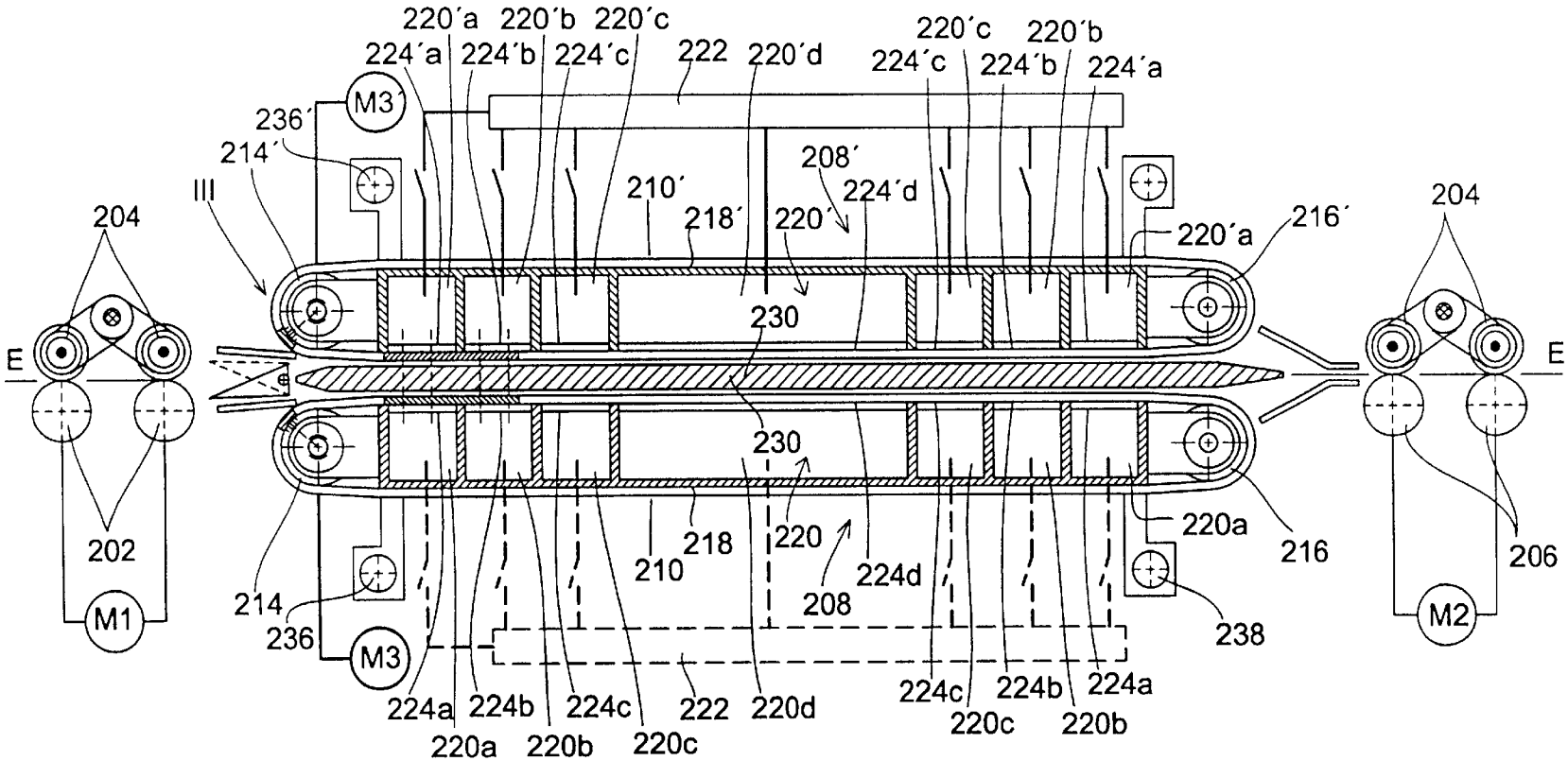
FIG. 6 shows a longitudinal section according to line II—II of FIG. 5.

At the inlet of this merger 200, draw-in transport rolls 202 are provided, which are continuously driven by a motor M1 (FIG. 6). These draw-in transport rolls 202 are rolls having a smooth surface, the paper sheets 10, 12 being pressed against this smooth surface by means of contact pressure rolls 204 in the manner known. At the outlet of the merger 200 two uniformly implemented discharge transport rolls 206 are provided, which are adapted to be driven continuously by a motor M2. The draw-in transport rolls 202 and the discharge transport rolls 206 can also be driven by a common motor making use of an intermediate toothed belt.

The device according to the present invention includes at least one lower vacuum transport unit 208. It will, however, be expedient to provide two lower vacuum transport units 208, which are arranged in parallel, since this will improve the performance accuracy and the operational reliability of the device still further. The two lower vacuum transport units 208 are arranged below the paper travelling plane E—E (FIG. 6) and are each associated with one of the two paper sheet rows R1 and R2. Each of these vacuum transport units 208 is provided with an endless conveying belt 210 provided with perforations 212. The conveying belt 210 is guided over two deflection pulleys 214, 216; deflection pulley 214 is adapted to be driven via the schematically outlined motor M3. The motor M3 can simultaneously serve to drive the deflection pulley 214 of the second lower vacuum transport unit 208. The deflection pulleys 214, 216 are arranged on opposite ends of a support 218. Between the two deflection pulleys 214, 216, a vacuum chamber 220 is additionally provided, which, in the embodiment shown, is integrated in the support 218. This vacuum chamber 220 is open towards the upper tight run 210*a* of the conveying belt 210. The upper tight run 210*a* borders on the paper travelling plane E—E and is arranged only at a small distance from this paper travelling plane.

For adapting the device to various format heights, the vacuum chamber 220 is expediently subdivided into individual chambers 220*a*, 220*b*, 220*c* in its longitudinal direction, the individual chambers 220*a*, 220*b*, 220*c* being adapted to be selectively connected to a vacuum source 222.

Only the middle individual chamber 220*d* may continuously be connected to the vacuum source 222. Each of the individual chambers 220*a*–220*d* has a longitudinal section 224*a*–224*d* which is open towards the tight run 210*a*.

Instead of a vacuum chamber 220 which is subdivided into individual chambers, it would also be possible to provide a single continuous vacuum chamber having a longitudinal section that is open towards the tight run 210*a*. By means of slide members, which are not shown, the end sections of the slot could then be closable along a predetermined length in dependence upon the format height of the respective paper sheets to be superimposed.

Figure 5:
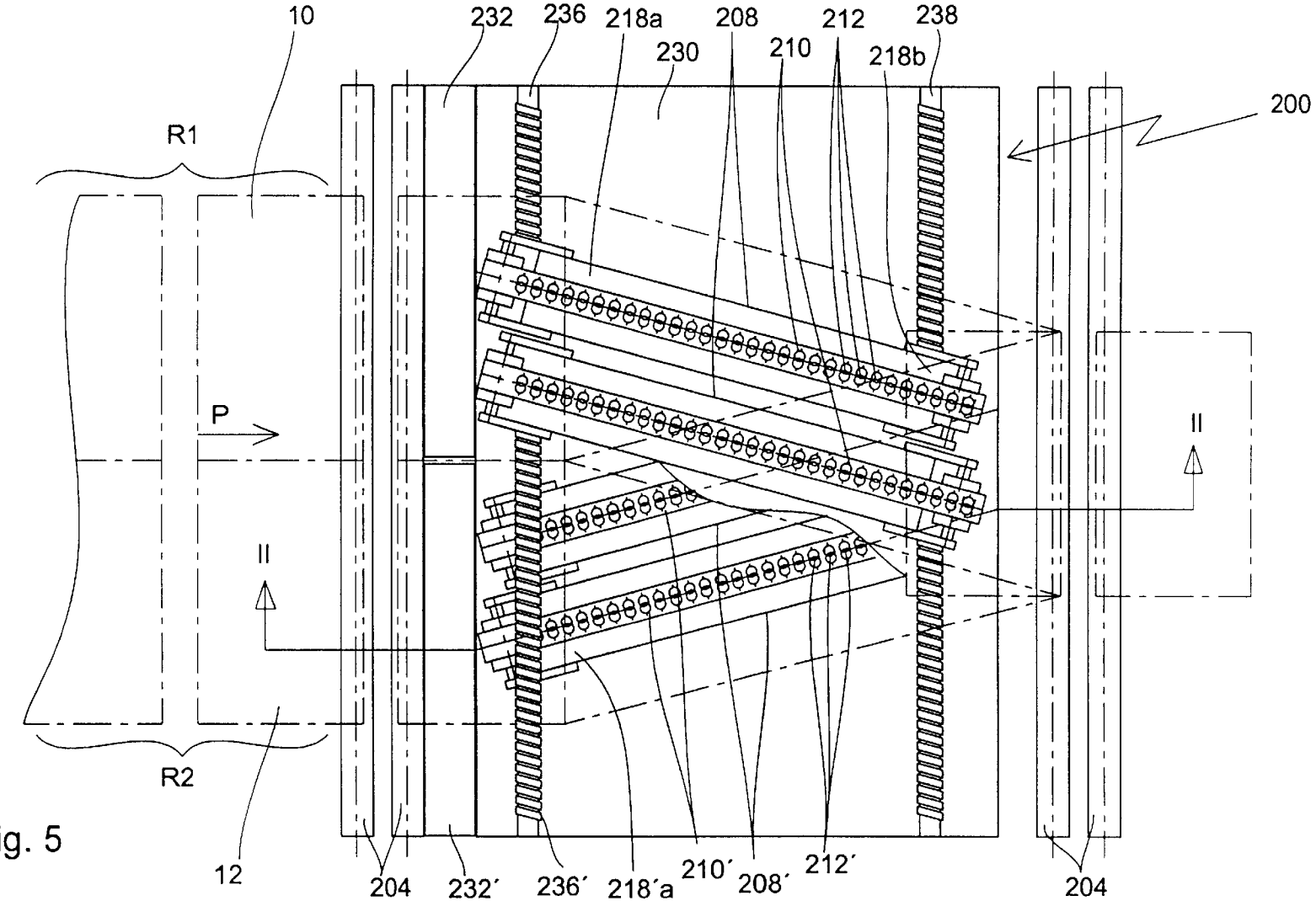
FIG. 5 shows a second embodiment of the device according to the present invention.

As can additionally be seen in FIG. 5, the two ends 218*a*, 218*b* of the support 218 are displaced relative to one another in the paper travelling direction P. By means of a respective adjustment device 236 and 238, which is expediently implemented as a screw rod extending at right angles to the paper travelling direction P and parallel to the paper travelling plane E—E, the ends 218*a*, 218*b* can be adjusted independently of one another. The adjustment devices 236, 238 can be driven by hand or by a respective stepping motor.

For the second paper sheet row R2 at least one upper vacuum transport unit 208' is provided, which is arranged above the paper travelling plane E—E. Also in this case, it will be expedient to associate two vacuum transport units 208', which are arranged in parallel, with the paper sheet row R2. The upper vacuum transport units 208' have a similar structural design as the lower vacuum transport units 208; the upper vacuum transport units 208', their constituent parts and the components co-operating therewith are therefore provided with the same reference numerals as the vacuum transport units 208 and their components, the respective reference numerals having only added thereto a prime. It follows that the above description of the lower vacuum transport units 208 applies mutatis mutandis also to the upper vacuum transport units 208'. The upper vacuum transport units 208' differ from the lower ones only insofar as in the upper vacuum transport units 208' the respective lower run 210'*a* of the conveying belt 210' defines the tight run and that the vacuum chambers 220' are therefore open at the bottom. The lower tight run 210'*a* is arranged adjacent the paper travelling plane E—E in closely spaced relationship therewith.

In order to allow the tight runs 210*a* and 210'*a* to be arranged as closely as possible below and above the paper travelling plane and in order to avoid the necessity of deflecting the paper sheets 10, 12 more than necessary from this paper travelling plane, it will be expedient to provide between the lower vacuum transport units 208 and the upper vacuum transport units 208' a thin separating plate 230 extending in the paper travelling plane. By means of this separating plate 230, the two paper sheets 10, 12 to be superimposed are guided separately from one another while they are being superimposed and, in addition, the upper paper sheet will primarily be prevented from being sucked onto the lower vacuum transport units 208 and the lower paper sheet will primarily be prevented from being sucked onto the upper vacuum transport units 208'. The separating plate 230 may also consist of transparent material, such as acrylic plastic or glass; this is also the reason for the fact that the vacuum transport units 208 located below the transparent separating plate 230 and the components co-operating therewith are visible in FIG. 5.

Figure 7:
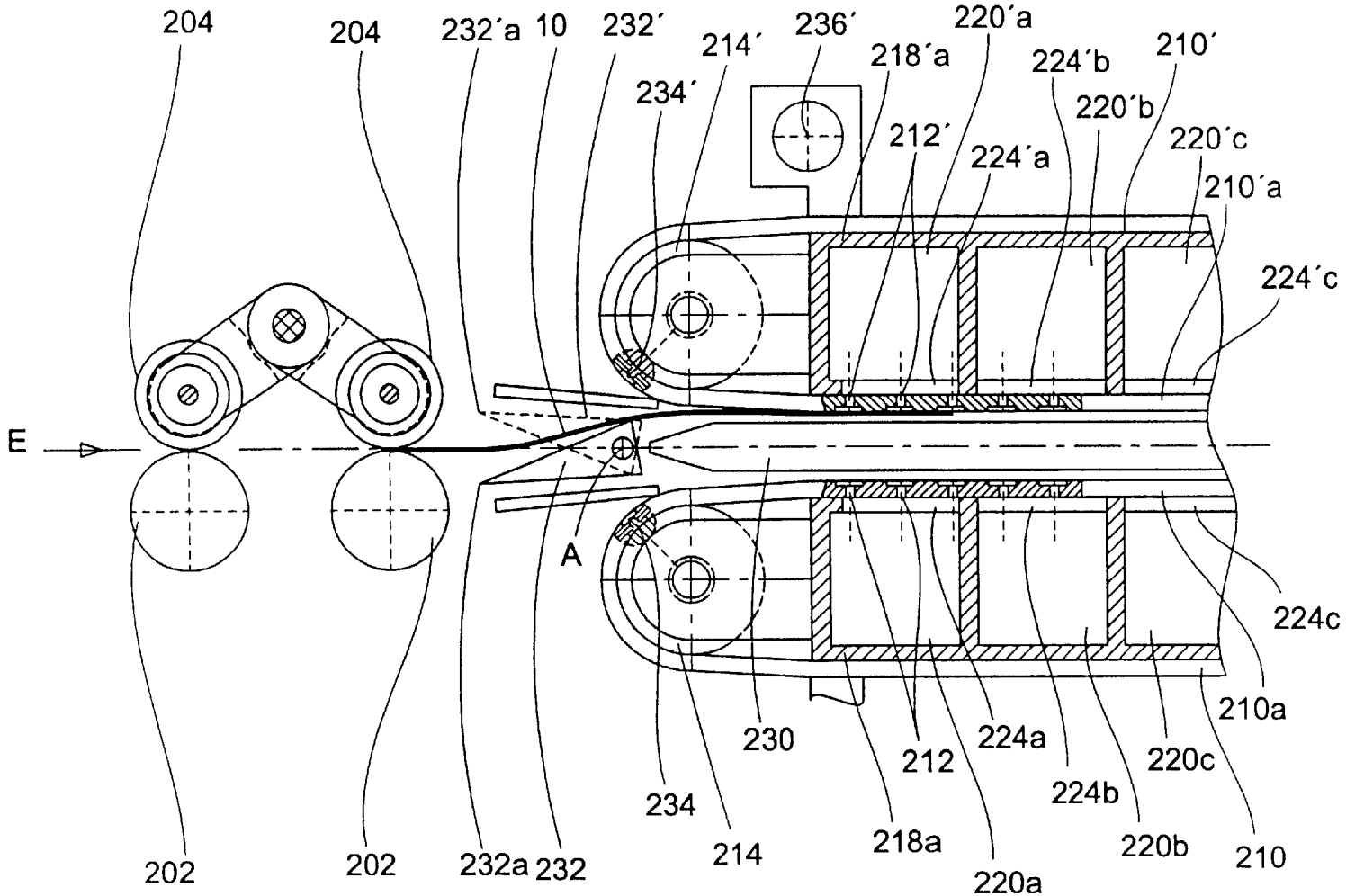
FIG. 7 shows a partial longitudinal section at location III of FIG. 6.

In order to guarantee that the respective paper sheet is supplied to the associated vacuum transport units, a guide means 232, 232' for each paper sheet row R1, R2 is provided in front of the separating plate 230. In order to be able to adapt the device to various modes of operation, the inlet end 232*a* and 232'*a* of each guide means 232, 232' is vertically adjustable. It will be expedient to implement the two guide means 232, 232' like a switch blade and such that they are pivotable about a pivot axle A independently of one another, the pivot axle A extending in the paper travelling path E—E and at right angles to the paper travelling direction. The paper sheets originating from one of the paper sheet rows R1 and R2, respectively, can in this way be conducted selectively to the upper or to the lower side of the separating plate and the paper sheets of the other paper sheet row can be conducted to the opposite lower or upper side of the separating plate 230. If e.g. the paper sheets 10 originating from paper sheet row R1 are to be advanced by the lower vacuum transport units 208, the guide means 232 will be pivoted upwards, as shown in FIG. 7. This has the effect that the paper sheets 10 of paper sheet row R1 are conducted to the tight runs of the lower vacuum transport units 208. For paper sheet row R2, the inlet end 232'*a* of the guide means 232' will then be pivoted downwards and the paper sheets 12 will consequently be conducted to the tight runs 212'*a* of the upper vacuum transport units 208'.

In order to guarantee a precise mode of operation of the device, it will additionally be of advantage when the driven deflection pulleys 214, 214' are provided with projections 234, 234' engaging complementary openings in the associated transport belt 210, 210'. The openings can be defined by the perforations 212, 212' of the conveying belt 210, 210', as in the case of the embodiment shown. The conveying belts can, however, also be implemented like a toothed belt and the driven deflection pulleys are then provided with complementary teeth on the periphery thereof.

Figure 8:
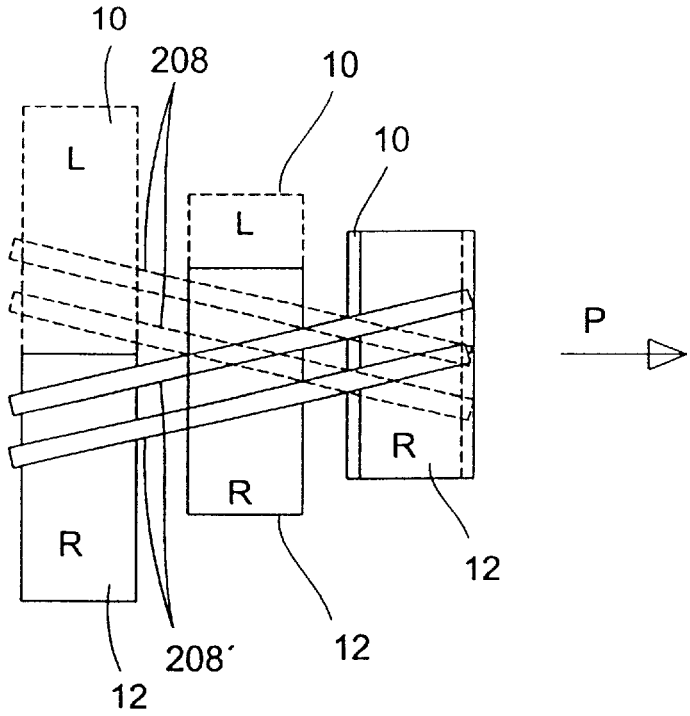
FIGS. 8–11 show schematic representations of various modes of operation of the device according to the second embodiment.

The mode of operation of the device according to the present invention is now described making first reference to FIGS. 5 to 8. In the case of this mode of operation, the paper sheets R1, R2 originating from the two paper sheet rows R1, R2 are alternately superimposed in a shingled mode of arrangement. In so doing, the paper sheet 12 constituting the right paper sheet in the paper travelling direction will be placed on top of the respective left paper sheet 10. Furthermore, the paper sheets will be superimposed symmetrically with respect to the longitudinal centre plane of the device, this being referred to as "centre-symmetric processing". For this purpose, the lower vacuum transport units 208 are used for transporting the paper sheets 10 originating from the left paper sheet row R1 and the upper vacuum transport units 208' are used for transporting the paper sheets 12 originating from the right paper sheet row R2. The guide means 232, 232' are adjusted in the way shown in FIG. 7. The lower vacuum transport units 208 are adjusted such that their outlet-side ends are inclined towards the longitudinal centre plane, and also the upper vacuum transport units 208' are adjusted in the opposite direction again such that their outlet-side ends are inclined at an oblique angle towards the longitudinal centre plane, as can be seen in FIGS. 5 and 8.

The paper sheets 10, 12 are transported in the paper travelling direction P by the transport rolls 202 of the draw-in transport means. In the course of this process, paper sheet 10 is conducted by the guide means 232 to the tight run 210*a* of the lower vacuum transport units 208 and paper sheet 12 is conducted by the guide means 232' to the tight run 210'*a* of the upper vacuum transport units 208'. Due to the vacuum, which prevails in the vacuum chamber 220 and which becomes effective first through the slot 224*a* and subsequently also through the slots 224*b*, 224*c* and 224*d* and the perforations 212, paper sheet 10 is sucked onto the tight run 210*a* and taken over by the continuously running conveying belt 210. In view of the fact that the conveying belt extends at an oblique angle relative to the longitudinal centre plane, the paper sheet 10 will simultaneously be advanced in the paper travelling direction P and also in a direction towards the longitudinal centre plane. In a similar way, paper sheet 12 is taken over by the tight run 210'*a* of the conveying belt 210' of the upper vacuum transport units 208' and laterally displaced in the opposite direction towards the longitudinal centre plane at a speed differing from the speed at which the first sheet is moved. Each paper sheet is only displaced by half the paper sheet width. On the outlet side of the device, the two paper sheets are superimposed in a shingled mode of arrangement.

The superimposed paper sheets 10, 12 are then seized by the transport rolls 206 of the discharge transport means and advanced.

Figure 9:
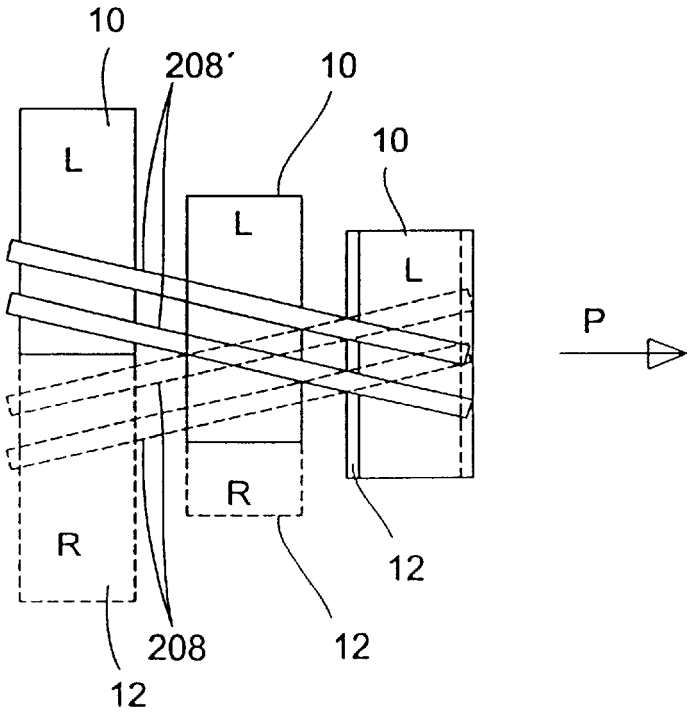

When, in a similar mode of operation, the left paper sheet 10 is to be placed on top of the right paper sheet, the vacuum transport units are adjusted via adjustment means 236, 238 in accordance with FIG. 9. Also the guide means 232, 232' are reset accordingly. In this case, the upper vacuum transport units 208' will then carry out the transport of the left paper sheet 10 and the lower vacuum transport units 208 will carry out the transport of the right paper sheet 12.

Figure 10:
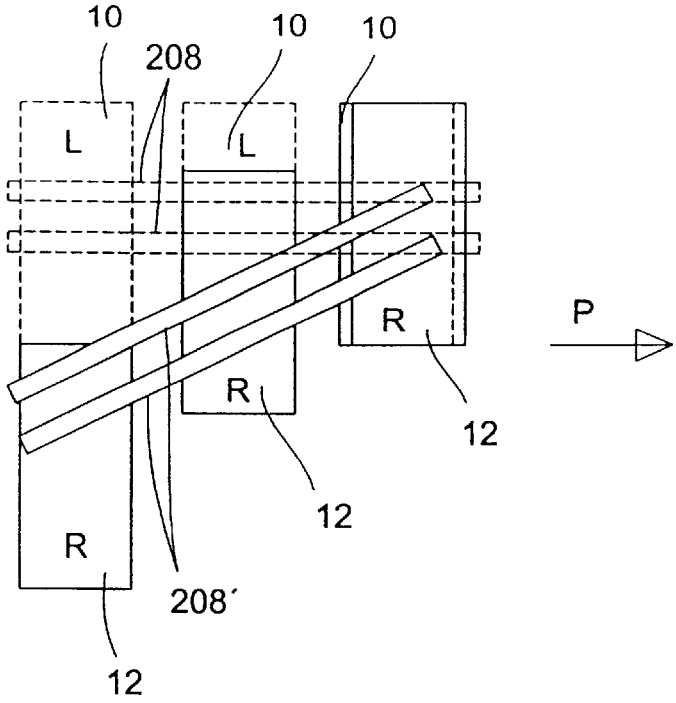
Figure 11:
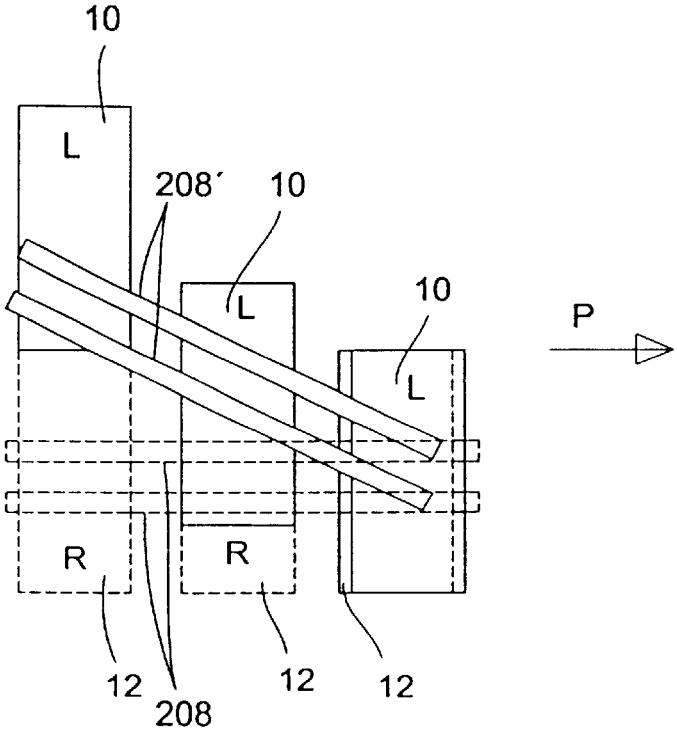

The description of the mode of operation of the device according to the present invention will now be continued making reference to FIGS. 10 and 11. From FIG. 10 it can be seen how the paper sheets 12 originating from the right paper sheet row R2 can be displaced to the left by adjusting the lower vacuum transport units 208 parallel to the paper travelling direction P and the upper vacuum transport units 208' such that they extend at an oblique angle relative to the paper travelling direction P, whereas the paper sheets 10 originating from the left paper sheet row R1 will only be advanced straight ahead. In this way, "fixed edge on the left" paper processing can be executed.

When the upper vacuum transport units 208' extend at an oblique angle in the opposite direction (FIG. 11), "fixed edge on the right" paper processing can be executed. In the examples shown in FIGS. 10 and 11, the sheets are moved at the same speed.

The device can be actuated either by hand or by means of a pre-programmed control, which acts on motors that are connected to the screw rods 236, 236' and 238, 238', respectively.

The subdivision of the vacuum chambers 220 and 200' into a plurality of individual chambers or the covered end sections of the slot of a continuous vacuum chamber is/are necessary for adapting the device to various format heights. In the case of the smallest format height of e.g. 75 mm (3 inches) all the individual chambers 220*a*–220*d* and 220'*a*–220'*d*, respectively, are connected to the vacuum source 222. When slide members are used, the longitudinal section of the continuous vacuum chamber must be open in full length in this case. When the paper sheets to be processed have, however, a larger format height, attention should be paid to the fact that these paper sheets should not be sucked onto the conveying belts 210, 210' of the vacuum transport units 208, 208' until the trailing edge of the respective paper sheet is just leaving the last transport roll of the draw-in transport means. On the outlet side of the device, the respective paper sheets should remain sucked onto the conveying belts 210, 210' only until the leading edge of the respective paper sheet is seized by the first transport roll of the discharge transport means. In order to guarantee this, a larger or smaller number of draw-in chambers 220*a*, 220*b*, 220*c* and 220'*a*, 220'*b*, 220'*c* is disconnected from the vacuum source 222 on the inlet side and on the outlet side of the vacuum transport units 208, 208' or the end sections of the slot of a continuous vacuum chamber are closed along a greater or lesser length by slide members, depending on the format height of the paper sheets.

Although in the above description it has only been described how two sheets are arranged in a shingled mode of arrangement, it is clearly evident that also more than two sheets can be merged; this leads to a corresponding increase in the number of the components described hereinbefore.

In the above-described arrangements, the speed difference between the two sheets is accomplished by the different speeds of the oblique transport means (FIGS. 2 to 4) and of the vacuum transport units (FIGS. 5 to 7), respectively. Instead of this solution, the necessary travelling difference of the sheets can be achieved by delaying the individual sheets at the inlet of the merger to different degrees. For this purpose, e.g. the stop points described in FIGS. 2 to 4 can be used, which will then also be provided in the case of the arrangement according to FIGS. 5 to 7. During sheet supply, e.g. the first sheet will not be delayed, whereas the second sheet will be stopped by the stop point for a short time, i.e. it will be delayed in time. In this case, the transport units can operate at the same speed, since the necessary amount of displacement will be achieved by the delay of at least one sheet on the inlet side. The power losses occurring due to the fact that at least one sheet is stopped are small and do not lead to a lasting influence on the overall behaviour of the machine.

As many and varied modifications to the subject matter of this invention will become apparent to those skilled in the art from the detailed description given hereinabove, it will be understood that the present invention is only limited as provided in the following claims.

What is claimed is:

1. A method of arranging in a shingled mode of arrangement at least two sheets, which are arranged side by side in a sheet traveling plane at an initial position, along a paper travelling direction at a final position, said method comprising the following steps:

moving a first sheet of the at least two sheets from said initial position substantially in the sheet travelling plane in a first direction at a first acute angle relative to the paper travelling direction at a first speed to said final position; and moving a second sheet of the at least two sheets from said initial position substantially in the sheet travelling plane in a second direction at a second acute angle relative to the paper travelling direction at a second speed to said final position, wherein said first and second angles are not equal to zero, and wherein either the first speed is different from the second speed and the first angle is opposed and equal in value to the second angle, or the first speed is equal to the second speed and the first angle is different from the second acute angle, in such a way that the final position is arranged in a direction perpendicular to the paper travelling direction between the initial positions of the at least two sheets; and guiding the first sheet and the second sheet by a guide means when the sheets are being slid on top of one another, said guide means separating the sheets at least partially, said first sheet and said second sheet being moved in such a way that their edges are superimposed along the paper travelling direction at the final position.

2. A method according to claim 1, wherein the first angle and the second angle are opposed and equal in value, and wherein the first speed is different from the second speed.

3. A method according to claim 1, wherein each of the sheets is displaced by half its format width in a direction perpendicular to the paper travelling direction.

4. A method according to claim 1, wherein the first speed is in the range of from 2 m/s to 5 m/s, and the second speed is in the range of from $1.05 \times v_1$ to $1.2 \times v_1$.

5. A method according to claim 1, wherein the displacement of the edges representing the leading edges in the paper travelling direction is in the range of from 10 mm to 50 mm.

6. A method according to claim 1, comprising the following steps:

providing the sheets which are to be arranged in a shingled mode of arrangement, said sheets being arranged side by side in the paper travelling direction; and transporting the shingled sheets away.

7. A device for arranging in a shingled mode of arrangement at least two sheets, which are arranged side by side in a sheet travelling plane at an initial position, along a paper travelling direction at a final position, said device comprising:

a first transport means moving a first sheet of the at least two sheets from said initial position substantially in the sheet travelling plane in a first direction at a first acute angle relative to a paper travelling direction at a first speed to said final position;

a second transport means moving a second sheet of the at least two sheets from said initial position substantially in the sheet travelling plane in a second direction at a second acute angle relative to the paper travelling direction at a second speed to said final position, wherein said first and second angles are not equal to zero, and wherein either the first speed is different from the second speed and the first angle is opposed and equal in value to the second angle, or the first speed is equal to the second speed and the first angle is different from the second acute angle, in such a way that the final position is arranged in a direction perpendicular to the paper travelling direction between the initial positions of the at least two sheets;

a guide means which separates the first sheet and the second sheet at least partially and which serves to guide said first sheet and said second sheet when said sheets are being slid on top of one another by the first and second transport means; and said first sheet and said second sheet being moved in such a way that their edges are superimposed along the paper travelling direction at the final position.

8. A device according to claim 7, wherein the first angle and the second angle are opposed and equal in value, and wherein the first speed is different from the second speed.

9. A device according to claim 7, wherein the first and second transport means displace each of the first and second sheets by half the sheet format width in a direction perpendicular to the paper travelling direction.

10. A device according to claim 7, wherein the first speed is in the range of from 2 m/s to 5 m/s, and the second speed is in the range of from $1.05 \times v_1$ to $1.2 \times v_1$.

11. A device according to claim 7, wherein the displacement of the edges representing the leading edges in the paper travelling direction is in the range of from 10 mm to 50 mm.

12. A device according to claim 7, comprising reception means receiving the sheets, which are arranged side by side in the paper travelling direction and which are to be arranged in a shingled mode of arrangement, and transferring them to the transport means; and a discharge transport means used for transporting away the shingled sheets.

13. A device according to claim 7, wherein the transport means are implemented as oblique transport means who respective transport directions extend obliquely at an acute angle relative to a longitudinal centre plane, and wherein a separate oblique transport means is provided for each of the two sheets, the transport directions of these oblique transport means extending obliquely at opposed acute angles towards the longitudinal centre plane so as to slide the two paper sheets at an oblique angle towards the longitudinal centre plane and one on top of the other.

14. A device according to claim 13, wherein each of the oblique transport means comprises a plurality of pairs of rolls, the upper rolls being adapted to be raised from the lower rolls.

15. A device according to claim 13, comprising in addition first and second stop means which extend parallel to the longitudinal centre plane, the distance between each of said stop means and the longitudinal centre plane corresponding approximately to half the format width of the paper sheets.

16. A device according to claim 15, wherein the guide means includes a respective guide plate for each of the sheets between the oblique transport means, said respective guide plate extending parallel to the paper travelling plane from one side of the longitudinal centre plane up to the stop means arranged on the other side of said longitudinal centre plane.

17. A device according to claim 16, comprising in addition stop means which are implemented as a bent portion of the guide plates, said guide plates being adapted to be displaced transversely to the paper travelling direction so as to be adjustable to the format width of the sheets.

* * * * *

UNITED STATES PATENT AND TRADEMARK OFFICE

CERTIFICATE OF CORRECTION

PATENT NO. : 6,814,351 B2
DATED : November 9, 2004
INVENTOR(S) : Koelle, Helmut

It is certified that error appears in the above-identified patent and that said Letters Patent is hereby corrected as shown below:

Title page,
Item [73], Assignee, should read -- Boewe Systec AG --, not "Boewe Systems AG".

Signed and Sealed this

Nineteenth Day of April, 2005

JON W. DUDAS
*Director of the United States Patent and Trademark Office*